US010371434B2

(12) United States Patent
Eschner et al.

(10) Patent No.: US 10,371,434 B2
(45) Date of Patent: Aug. 6, 2019

(54) NO-FROST REFRIGERATION DEVICE

(71) Applicant: BSH BAUSGERAETE GMBH, Munich (DE)

(72) Inventors: Torsten Eschner, Ulm (DE); Panagiotis Fotiadis, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 51 days.

(21) Appl. No.: 15/521,902

(22) PCT Filed: Oct. 29, 2015

(86) PCT No.: PCT/EP2015/075143

§ 371 (c)(1),
(2) Date: Apr. 26, 2017

(87) PCT Pub. No.: WO2016/074941

PCT Pub. Date: May 19, 2016

(65) Prior Publication Data

US 2017/0314840 A1 Nov. 2, 2017

(30) Foreign Application Priority Data

Nov. 10, 2014 (DE) ..... 10 2014 222 851

(51) Int. Cl.
*F25D 17/06* (2006.01)
*F25D 21/08* (2006.01)
*F25D 21/06* (2006.01)

(52) U.S. Cl.
CPC ..... *F25D 17/062* (2013.01); *F25D 21/08* (2013.01); *F25D 21/06* (2013.01); *F25D 2700/10* (2013.01)

(58) Field of Classification Search
CPC ..... F25D 17/065; F25D 17/062; F25D 21/08; F25D 2700/10; F25D 21/06; F25D 21/14; F25D 17/067; F25D 11/022; H05B 3/42; F25B 47/02
See application file for complete search history.

(56) References Cited

U.S. PATENT DOCUMENTS 3,638,449 A * 2/1972 Lichtenberger ..... F25D 17/062 62/272
2005/0025952 A1* 2/2005 Field ..... B32B 27/04 428/304.4
2009/0133425 A1* 5/2009 Goerz ..... F25D 17/067 62/264

(Continued)

FOREIGN PATENT DOCUMENTS

DE 102009028778 A1 2/2011
DE 102012213644 A1 2/2014

(Continued)

*Primary Examiner* — Emmanuel E Duke
(74) *Attorney, Agent, or Firm* — Laurence A. Greenberg; Werner H. Stemer; Ralph E. Locher

(57) ABSTRACT

A no-frost refrigeration device includes a forced-air evaporator in an evaporator compartment. At least a first component of the evaporator separates an upstream sector and a downstream sector of the evaporator compartment from one another. One of the two sectors of the evaporator compartment contains an accumulation zone that is fluidically parallel and adjacent to a second component of the evaporator and is cooled by the second component of the evaporator.

15 Claims, 2 Drawing Sheets

(56) References Cited

U.S. PATENT DOCUMENTS

| | | | | |
|---|---|---|---|---|
| 2009/0151387 | A1* | 6/2009 | Fotiadis | F16K 31/521 62/441 |
| 2009/0165486 | A1* | 7/2009 | Harlen | F25D 21/08 62/276 |
| 2012/0042683 | A1* | 2/2012 | Malisi | F25D 17/067 62/426 |
| 2015/0219385 | A1* | 8/2015 | Harlen | F25D 21/08 62/80 |

FOREIGN PATENT DOCUMENTS

| | | | | |
|---|---|---|---|---|
| GB | 1368872 | A | 10/1974 | |
| WO | WO 2016074893 | A1 * | 5/2016 | F25D 21/04 |

* cited by examiner

NO-FROST REFRIGERATION DEVICE

BACKGROUND OF THE INVENTION

Field of the Invention

The present invention relates to a no-frost refrigeration appliance with a forced-ventilation evaporator, which is arranged in an evaporation chamber.

Usually, the evaporator in a no-frost refrigeration appliance divides the evaporation chamber into an upstream part and a downstream part, such that the air is forced to flow through the entire length of the evaporator on its way through the evaporation chamber. When the forced ventilation of the evaporator is in operation and air is flowing through the evaporator at a high speed, moisture carried by the air is preferably deposited at the coldest point of the evaporator as frost, i.e. next to an injection point, at which refrigerant enters into the evaporator. The frost buildup may lead to a blockage of the evaporator after a period of time, so that the air flow through the evaporation chamber comes to a halt and connected storage compartments of the refrigeration appliance are no longer cooled. Before this point is reached, the evaporator must be defrosted, wherein the problem arises of distributing heat fed to the evaporator such that said evaporator defrosts completely, but at the same time parts of the evaporator, which become ice-free earlier than others, are not heated unnecessarily above the freezing point, as the thermal energy used therefore brings no practical use and rather energy must once again be expended following the end of the defrosting operation in order to cool down said unnecessarily heated regions of the evaporator once more.

SUMMARY OF THE INVENTION

An object of the present invention is to specify a no-frost refrigeration appliance, which enables an energy-efficient defrosting.

The object is achieved, in the case of a no-frost refrigeration appliance with a forced-ventilation evaporator, which is arranged in an evaporation chamber, wherein at least one first part of the evaporator separates an upstream part and a downstream part of the evaporation chamber from one another, by one of the two parts of the evaporation chamber having an accumulation region, which is arranged in parallel with a second part of the evaporator in terms of flow, and is cooled by the second part of the evaporator. This accumulation region offers the air circulating through the evaporation chamber a path with relatively low flow resistance, so that a majority of the air only flows through the first part of the evaporator and the accumulation region, instead of through the entire evaporator, but moisture is separated out here in the accumulation region as frost. This frost increases the flow resistance of the accumulation region over time, so that the air flow through the second part of the evaporator increases and frost is increasingly deposited there too. A blockage only arises, however, if both the accumulation region and the second part of the evaporator have been filled up with frost. As the frost forms a body extending in the flow direction of the air, at least in the accumulation region, during defrosting it can prevent a local overheating at least of the second part of the evaporator in direct thermal contact with the accumulation region, and thus enables a defrosting with good energy efficiency. As the accumulation region makes additional space available for the frost, the intervals between defrosting cycles may be extended as well.

This has a positive effect on the energy consumption of the appliance; moreover, it is also convenient for the user if times, during which no cooling output can be requested in order to cool down items newly introduced into the appliance, are rare. In order to achieve an efficient cooling of the accumulation region and a correspondingly strong concentration of frost buildup on the accumulation region, the second part of the evaporator must be able to achieve lower temperatures than the first. An injection point for refrigerant is therefore preferably provided on the second part.

Preferably, the second part as a whole should lie upstream of the first part of the evaporator with reference to the flow direction of refrigerant in a refrigerant pipe of the evaporator, so that the refrigerant only reaches the first part once it has already been heated to an extent in the second part.

If the evaporator is essentially cuboid-shaped in a manner known per se, with an inflow side and an outflow side, which are oriented to be perpendicular to the flow direction of the air in the first part of the evaporator, and with flanks connecting the inflow side and the outflow side, the accumulation region can be expediently adjacent to a first of said flanks.

The evaporator is preferably open on said first flank, in order to enable a transfer of air between the accumulation region and the second part of the evaporator across the entire length of the accumulation region.

The first flank is preferably structured in the flow direction into a section adjacent to the accumulation region and a section adjoining a wall of the evaporation chamber and delimiting the first part of the evaporator.

The section adjacent to the accumulation region can also be delimited from the section adjoining the wall of the evaporation chamber transversely relative to the flow direction on both sides. Such an arrangement can then particularly benefit an even distribution of the air across the width of the evaporation chamber if air inlets of the upstream part of the evaporation chamber are arranged on each of the side corners of the evaporation chamber.

A defrost heater can be arranged on a second flank of the evaporator opposite the first flank. The defrost heater is preferably embodied as a large-surface heating element which extends over at least the second part of the evaporator, in order to defrost said part and the accumulation region. It can expand across the entire second flank, in order to also defrost the first part of the evaporator; the defrost heater can, however, have a lower heating output per unit area at the level of the first part of the evaporator than at the level of the second part, as the quantity of frost in the first part is generally smaller than that in the accumulation region and in the second part of the evaporator.

The inflow side and the outflow side of the evaporator are preferably spaced apart in the depth direction of the refrigeration appliance. Thus, in particular, the second flank of the evaporator can be a lower flank, so that the heat released by the large-surface heating element arranged there can rise in the evaporator and thus reach the accumulation region.

A wall of the evaporation chamber opposite the first flank of the evaporator can have an infrared-reflecting surface layer, in order to reflect radiant heat emitted by the evaporator back thereto or to the accumulation region and thus to make said radiant heat available for the defrosting.

It is particularly preferred that the accumulation region belongs to the upstream part of the evaporation chamber. Thus, the air flowing through the accumulation region can already release a majority of its moisture at this location, which considerably reduces the rate of frost formation in the first part of the evaporator. Another consequence of this feature is that, when the forced ventilation is switched off, air reaching the evaporation chamber from the storage compartment by way of convection also releases its moisture in the accumulation region or in the second part of the evaporator. The distribution of the frost in the evaporation chamber is therefore essentially irrespective of whether the moisture has reached the evaporation chamber with the forced ventilation switched on or off. The frost distribution can therefore be reproduced well and the defrost heater can be optimized in its form, arrangement, distribution of the heating line or the like, in order to achieve a defrosting time which is as uniform as possible for the entire evaporator.

A temperature sensor for monitoring the defrosting process is preferably arranged on the second part of the evaporator, preferably adjacent to the accumulation region, i.e. typically on the first flank of the evaporator. This ensures that the primary frost accumulation is always available in the region of the sensor.

If the accumulation zone is located above the sensor, the consequence is that when the frost has briefly thawed above the sensor, the remaining frost falls onto the sensor again from above and cools it. Thus the defrost heater remains active until the accumulation zone is free of frost.

A refrigerant outlet can also be arranged on the second part of the evaporator, next to the refrigerant inlet. Thus a suction line emerging from the refrigerant outlet forms a heat exchanger together with a capillary tube leading to the refrigerant inlet.

If the second part of the evaporator is facing a front side of the no-frost refrigeration appliance and the first part of the refrigeration appliance is facing a rear wall of the no-frost refrigeration appliance, one section of the suction line in particular, which runs from the second part of the evaporator to the rear wall in the evaporation chamber, can form the heat exchanger mentioned above.

BRIEF DESCRIPTION OF THE SEVERAL VIEWS OF THE DRAWING

Further features and advantages of the invention will emerge from the description of exemplary embodiments provided below, with reference to the attached figures, in which.

DESCRIPTION OF THE INVENTION

Figure 1:
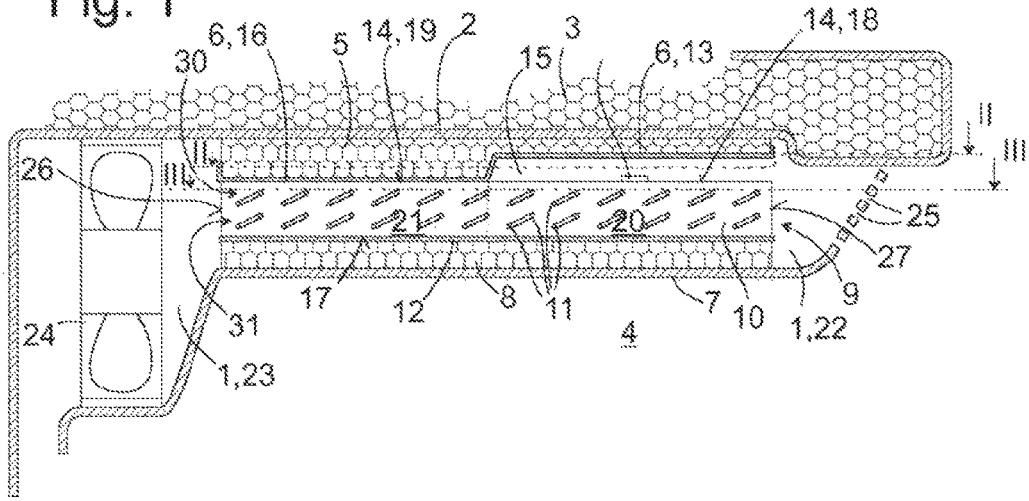
FIG. 1 shows a schematic longitudinal section through the evaporation chamber of an inventive refrigeration appliance.

FIG. 1 shows an evaporation chamber 1 of a domestic refrigeration appliance in a longitudinal section along a plane which extends vertically centrally and in the depth direction through a carcass of the domestic refrigeration appliance. A wall delimiting the evaporation chamber 1 upwardly is formed by a rigid plate 2, for example made of solid polystyrene, over which a thermal insulation layer 3 extends. The plate 2 can be part of an inner container of the refrigeration appliance, in which the thermal insulation layer 3 is generally a layer of polyurethane foam, with which an intermediate space between the inner container and an outer shell of the refrigeration appliance carcass is foamed in pack in the manner which is customary according to the state of the art. The plate 2 and the thermal insulation layer 3 can also, however, be parts of a horizontal dividing wall between two storage compartments formed in the carcass of the refrigeration appliance, here a freezer compartment 4 below the evaporation chamber 1 and a normal refrigerator compartment (not shown) above the thermal insulation layer 3.

A thermal insulation plate 5 made of expanded polystyrene is fastened below the plate 2. An infrared-reflecting layer 6 is formed on an underside of said thermal insulation plate 5, here in the form of a metal sheet, preferably made of aluminum, which fits closely against the contour of the underside of the thermal insulation plate 5.

A lower wall, which separates the evaporation chamber 1 from the freezer compartment 4, comprises a tray 7 injection molded from plastic, which is anchored to the plate 2 and possibly to a rear wall of the inner container, as well as a further thermal insulation plate 8 made of expanded polystyrene, which is glued into the tray 7.

A cuboid-shaped evaporator 9 with a fin construction is arranged between the thermal insulation plates 5, 8. Its fins 10 extend in parallel to the section plane of FIG. 1 and are crossed a number of times by a refrigerant pipe 11 running in a meandering manner. On a lower flank 17 of the evaporator 9, lower edges of the fins 10 touch a large-surface heating element 12, which abuts against the thermal insulation plate 8 in a planar manner. The large-surface heating element 12 can, for example, be formed by a plate, such as an aluminum plate, with good thermal conductivity, to which a heating resistor, electrically insulated by being embedded in foils, is affixed.

The thermal insulation plate 5 and the IR-reflecting layer 6 attached thereto are divided in a depth direction of the carcass into a front section 13, which delimits an accumulation region 15 elongated in the depth direction of the carcass on an upper flank 14 of the evaporator 9 together with the upper edges of the fins 10, and a rear section 16, which touches the upper edges of the fins 10 of the evaporator 9 directly. A front part of the flank 14 adjacent to the accumulation region 15 is designated with 18, a rear part touching the rear section 16 is designated with 19; accordingly, a distinction is made in the following between a front part 20 of the evaporator 9 below the accumulation region 15 and a rear part 21 of the evaporator 9.

By the rear part 21 of the evaporator 9 touching the IR-reflecting layer 6 on one side and the large-surface heating element 12 on the other side, this causes the evaporation chamber 1 to be structured into an upstream part 22 and a downstream part 23. Air which is sucked from the freezer compartment 4 into the upstream part 22 by a fan 24 arranged in the downstream part 23 via inlet openings 25 on the upper rim of the tray 7 can only reach the downstream part 23 by flowing through the rear part 21 of the evaporator 9 below the rear section 16 of the layer 6 up to an outflow side 26. In order to reach this rear part 21, the air can immediately enter into the evaporator 9 on an inflow side 27 facing the inlet openings 25 and also flow through its front part 20; alternatively, there is a path on which the air initially enters into the accumulation region 15 and, by passing into the evaporator 9 via the front part 18 of the flank 14, bypasses its front part 20 at at least one part of its length.

Figure 2:
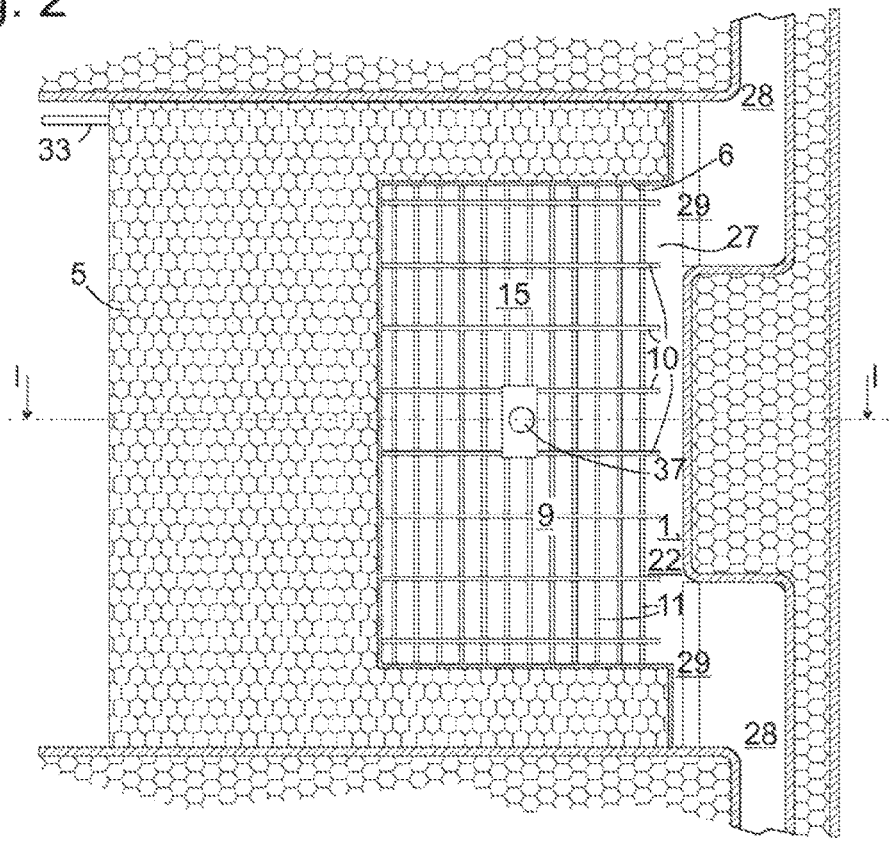
FIG. 2 shows a cross-section along the plane II-II from FIG. 1.

FIG. 2 shows a horizontal section through the evaporation chamber 1 along the plane II-II from FIG. 1. The section plane of FIG. 1 is designated with I-I in FIG. 2. Using the refrigerator compartment not shown in FIG. 1 as a basis, air channels 28 run through side walls of the carcass in each case and finally through the thermal insulation layer 3, in order to open into the upstream part 18 of the evaporation chamber 1 to the right and left of the inlet openings 25 in each case. The width of the accumulation region 15 is slightly smaller than that of the evaporation chamber 1, so that junctions 29 of the air channels 28 into the evaporation chamber 1 are opposite the accumulation region 15 at one part of their width in each case, while at another part the thermal insulation plate 5 protrudes immediately over the inflow side 27 of the evaporator 9. A part of the air flowing via the air channels 28 enters into the evaporator 9 directly via the inflow side 27 in this manner; the majority, however, is deflected sideways toward the center of the evaporation chamber and initially reaches the accumulation region 15.

Figure 3:
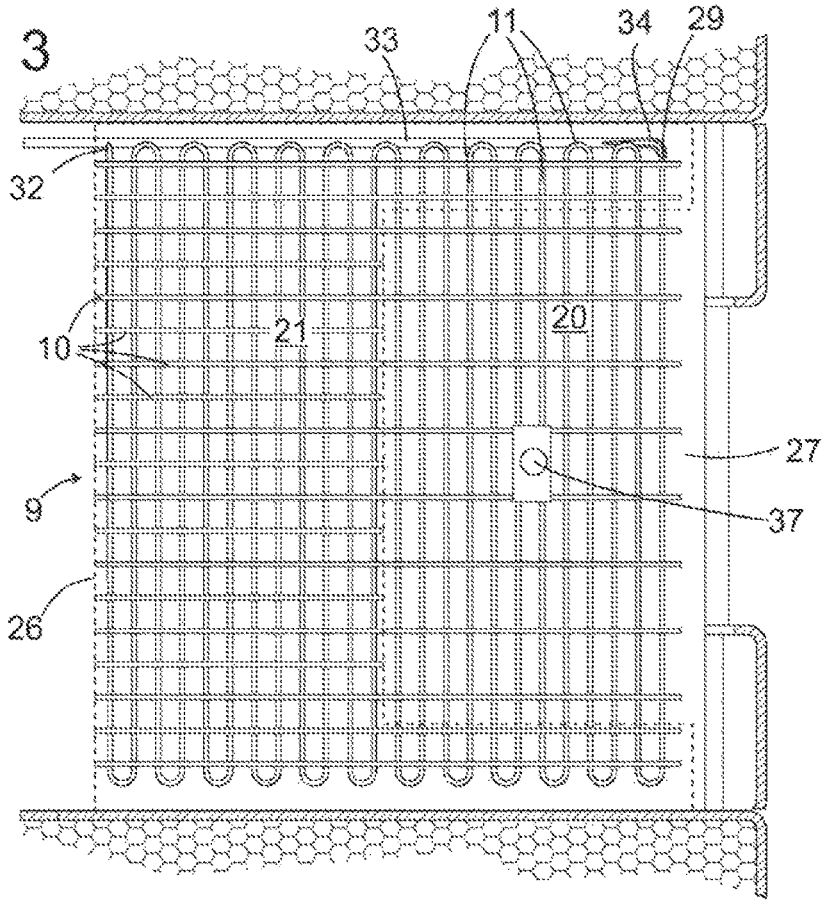
FIG. 3 shows a cross-section along the plane III-III from FIG. 1.

FIG. 3 shows the evaporator 9 in a second horizontal section along the plane III-III of FIG. 1, which lies deeper than the plane II-II. The outlines of the thermal insulation plate 5 and the accumulation region 15, which lie outside the section plane III-III, appear with a dashed line. The thickness of the fins 10 is different in the rear part 21 and in the front part 20, below the accumulation region 15. In the case illustrated here, the thickness of the fins 10 in the rear part 21 is twice as much as in the front, with every second fin 10 ending at the border of the front part 20.

The course of the refrigerant pipe 11 in the evaporator 9 can be clearly seen in FIG. 3. The refrigerant pipe 11 forms an upper position 30 (see FIG. 1) here which, starting from an injection point 29 on a front right corner of the evaporator 9, extends in the upper right of FIG. 3 in a meandering manner up to a rear right corner 32, and a lower position 31 which, covered by the upper position in a congruent manner, extends back to the front right corner. At this position the refrigerant pipe 11 passes into a suction line 33, which extends alongside the outermost right fin 10 in the direction of a rear wall of the refrigeration appliance carcass and runs therein downstream to a compressor (not shown). A capillary tube 34, via which fresh refrigerant reaches the injection point 29, is guided here on a part of its length inside the suction line 33, in order to form a heat exchanger, and first emerges herefrom shortly before the injection point 29.

The position of the injection point 29 next to the inflow side 27 of the evaporator 9 results in the front part 20 of the evaporator 9 reaching a considerably lower temperature than the rear part 21 when refrigerant circulates in the refrigerant pipe 11. Air which is sucked through the evaporation chamber 1 by the fan 20 in this time therefore already releases a substantial portion of its moisture on the upper edges of the fins 10 of the front part 20, so that frost grows into the accumulation region 15 starting from said upper edges. Thus, the flow resistance of the accumulation region 15 becomes greater as time passes, and the air is increasingly forced to enter into the evaporator 9 via the inflow side 27 and also to flow through its front part 20 to the extent that the accumulation region 15 is closing up.

The reduced thickness of the fins 10 in the front part 21 in comparison with the rear part 21 leads to the air, when it enters into the evaporator 9 via the inflow side 27, being able to cover a relatively long distance therein, before it has completely released its moisture, and the frost layer which is deposited here on the fins 10 extends far into the interior of the evaporator 9 starting from the inflow side 23. Thus, a large quantity of frost can be stored in the evaporator 9 and the accumulation region 15 before the flow resistance is increased to such a great extent that a defrosting must take place.

Figure 4:
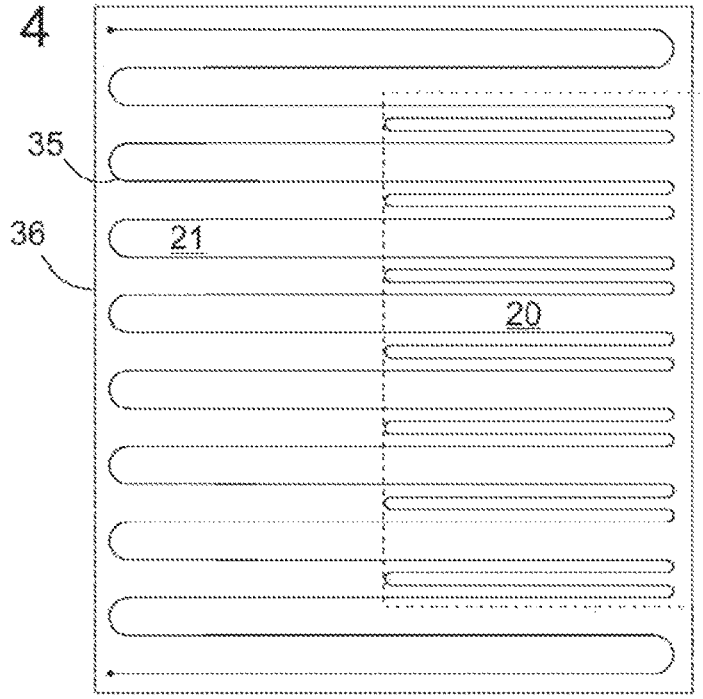
FIG. 4 shows a plan view of a large-surface heating element.

FIG. 4 shows a schematic plan view of an embodiment of the large-surface heating element 12. A heating filament 35 extends in a meandering manner on a thermally conductive base plate 36. The thickness of the meander or the length of the heating filament 35 per unit area of the base plate 36 is considerably higher below the front part 20 of the evaporator 9 than below the rear part 21, in order to be able to supply a quantity of heat necessary for defrosting the frost in the front part 20 and the accumulation region 15 in a short time frame and simultaneously to avoid an excessive heating of the less frosted rear part 21. A fine adjustment of the surface output in the front and rear part of the large-surface heating element 12 can take place by the heating filament 35 having different cross-sections in the front and rear part.

The defrosting procedure lasts until a temperature sensor 37, which is placed centrally in the front part 18 of the upper flank 14 of the evaporator 9, detects a predefined switch-off temperature of just above 0° C. The switch-off temperature is selected to be just above 0° C. so that it is achieved shortly after the complete defrosting of the front part 20 and the accumulation region 15.

The quantity of heat which the large-surface heating element 12 releases into the rear part 21 during the defrosting can be greater than the quantity of heat required to defrost the rear part 21. When the rear part 21 is already completely ice-free before the end of the defrosting procedure and it is still being heated, the heat reaches the rear section 16 of the infrared-reflecting layer 6 via the fins 10 and spreads out forward therein, so that the frost in the accumulation region 15 is also defrosted from above. Thus a close contact between the upper edges of the fins 10 and the layer 6 in the rear part 21 contributes in this case to avoiding an overheating of the rear part 21 which would have to be rectified again after the end of the defrosting procedure.

REFERENCE CHARACTERS

1 Evaporation chamber
2 Plate
3 Thermal insulation layer
4 Freezer compartment
5 Thermal insulation plate
6 Reflecting layer
7 Tray
8 Thermal insulation plate
9 Evaporator
10 Fin
11 Refrigerant pipe
12 Large-surface heating element
13 Front section (of the layer 6)
14 Upper flank
15 Accumulation region
16 Rear section (of the layer 6)
17 Lower flank
18 Front part (of the flank 14)
19 Rear part (of the flank 14)
20 Front part (of the evaporator 9)
21 Rear part (of the evaporator 9)
22 Upstream part (of the evaporation chamber 1)
23 Downstream part (of the evaporation chamber 1)
24 Fan
25 Inlet opening
26 Outflow side
27 Inflow side
28 Air channel
29 Injection point
30 Upper position
31 Lower position
32 Corner
33 Suction line

34 Capillary tube
35 Heating filament
36 Base plate
37 Temperature sensor

The invention claimed is:

1. A no-frost refrigeration appliance, comprising:

an evaporation chamber having an upstream part and a downstream part;

an evaporator being a forced-ventilation evaporator disposed in said evaporation chamber, said evaporator having at least one first part and a second part, said first part separating said upstream part and said downstream part of said evaporation chamber, with reference to a flow direction of air through said evaporation chamber, from one another, said second part of said evaporator having an injection point for refrigerant; and a part selected from the group consisting of said upstream part and said downstream part of said evaporation chamber having an accumulation region, being disposed in parallel with and adjacent to said second part of said evaporator in terms of flow, and is cooled by said second part of said evaporator.

2. The no-frost refrigeration appliance according to claim 1, wherein:

said evaporator has a refrigerant pipe; and said second part lies upstream of said first part of said evaporator with reference to the flow direction of the refrigerant in said refrigerant pipe of said evaporator.

3. The no-frost refrigeration appliance according to claim 1, wherein said evaporator is cuboid-shaped, with an inflow side and an outflow side, which are oriented to be perpendicular to the flow direction of the air in said first part of said evaporator, and with flanks connecting said inflow side and said outflow side, and that said accumulation region is adjacent to a first flank of said flanks.

4. The no-frost refrigeration appliance according to claim 3, wherein:

said evaporation chamber has a wall; and said first flank is structured in the flow direction into a first section adjacent to said accumulation region and a second section adjoining said wall of said evaporation chamber.

5. The no-frost refrigeration appliance according to claim 4, wherein said first section of said first flank adjacent to said accumulation region is also delimited from said second section adjoining said wall of said evaporation chamber transversely relative to the flow direction on both sides.

6. The no-frost refrigeration appliance according to claim 3, further comprising a defrost heater disposed on a second flank of said flanks of said evaporator opposite said first flank.

7. The no-frost refrigeration appliance according to claim 6, wherein said defrost heater is a large-surface heating element which extends over at least said second part of said evaporator.

8. The no-frost refrigeration appliance according to claim 3, wherein said inflow side and said outflow side are spaced apart in a depth direction of the no-frost refrigeration appliance.

9. The no-frost refrigeration appliance according to claim 3, wherein said evaporation chamber has a wall opposite said first flank, said wall has an IR-reflecting surface layer.

10. The no-frost refrigeration appliance according to claim 1, wherein said accumulation region belongs to said upstream part of said evaporation chamber.

11. The no-frost refrigeration appliance according to claim 1, further comprising a temperature sensor disposed on said second part of said evaporator.

12. The no-frost refrigeration appliance according to claim 11, wherein said temperature sensor is positioned adjacent to said accumulation region.

13. The no-frost refrigeration appliance according to claim 12, wherein said accumulation region extends above said temperature sensor.

14. The no-frost refrigeration appliance according to claim 1, further comprising a refrigerant outlet disposed on said second part of said evaporator.

15. The no-frost refrigeration appliance according to claim 1, further comprising:

a front side, said second part of said evaporator faces said front side of the no-frost refrigeration appliance;

a rear wall, said first part of said evaporator faces said rear wall of the no-frost refrigeration appliance;

a refrigerant inlet;

a capillary tube leading to said refrigerant inlet; and a suction line running from said second part of said evaporator to said rear wall and forming a heat exchanger together with said capillary tube leading to said refrigerant inlet.

* * * * *